US007186053B2

(12) United States Patent
Detzel

(10) Patent No.: US 7,186,053 B2
(45) Date of Patent: Mar. 6, 2007

(54) DISPOSABLE COVER FOR BUMPER BLOCKS

(76) Inventor: Rob W. Detzel, 124 Kennedy Rd., Fort Wright, KY (US) 41011

( * ) Notice: Subject to any disclaimer, the term of this patent is extended or adjusted under 35 U.S.C. 154(b) by 0 days.

(21) Appl. No.: 11/158,169

(22) Filed: Jun. 21, 2005

(65) Prior Publication Data

US 2006/0285919 A1 Dec. 21, 2006

(51) Int. Cl.
*E01C 11/22* (2006.01)

(52) U.S. Cl. ..... 404/8; 404/71; 404/75

(58) Field of Classification Search ..... 404/4–8, 404/71, 75; 256/1, 13.1
See application file for complete search history.

(56) References Cited

U.S. PATENT DOCUMENTS 5,082,744 A * 1/1992 Akao et al. ..... 428/522
5,722,357 A * 3/1998 Choi ..... 123/184.21
6,185,893 B1 * 2/2001 Gaston ..... 52/385
2004/0001932 A1 * 1/2004 Krause et al. ..... 428/41.7

OTHER PUBLICATIONS

Rob W. Detzel, *Affidavit of Rob W. Detzel*, Oct. 19, 2005, 2 pgs.

* cited by examiner

*Primary Examiner*—Raymond Addie
(74) *Attorney, Agent, or Firm*—Wood, Herron & Evans, L.L.P.

(57) ABSTRACT

A disposable cover for a bumper block comprises a body member having a cavity and an opening for receiving the bumper block. The body member is formed from an elastic polyethylene resin so that the body member may be expanded to accommodate the bumper block when the cover is placed thereon. In order to make the disposable cover, a tubular sheet of the polyethylene resin is flattened to form opposing sidewalls. Perforations are added at spaced apart locations along a length of the sheet, and the opposing sidewalls are heat sealed together proximate to the spaced apart locations. The sheet is cut along its length and the perforations are torn to form individual covers.

8 Claims, 3 Drawing Sheets

DISPOSABLE COVER FOR BUMPER BLOCKS

FIELD OF THE INVENTION

The present invention relates generally to protective covers, and more particularly, to a disposable cover for parking lot bumper blocks.

BACKGROUND OF THE INVENTION

Parking lots and other similar traffic surfaces are often subject to excessive wear and exposure to the elements. In order to prevent deterioration, such surfaces are often coated with a protective sealant after a certain amount of use and wear. For example, blacktop sealant is commonly applied to a parking lot surface in order to restore the surface to a more desirable condition and extend its useful life. The blacktop sealant is typically a coal tar material that must be spread in a thin layer over the parking lot surface. Because the tar material is very difficult to remove from a surface once it is applied, great care must be taken to ensure that the blacktop sealant is only applied to the desired parking lot surface and not to adjacent objects. Particularly, care must be taken to not unintentionally apply the sealant to bumper blocks, curbing, sign poles, and other objects located on or around the parking lot surface. As may be appreciated, coating these objects in the typically black sealant usually results in an undesirable appearance.

The most common method for coating parking lot surfaces with sealant is to use a mechanical spraying device. The spraying device is typically connected to a tank for storing and mixing the blacktop sealant, and includes numerous other components to help ensure that the sealant is evenly applied. In order to avoid coating bumper blocks and the like, all of the bumper blocks are often physically removed from the surface before applying the blacktop sealant. Although this method may allow the mechanical spraying device to coat the entire surface in an efficient manner, moving the bumper blocks can be an extremely costly, time-consuming, and difficult task. There are large numbers of such blocks, and most bumper blocks weigh between 150 and 220 pounds and require at least two workers with a dolly to remove and replace them. Also, metal rods that secure the bumper blocks in place are often bent during removal and must be replaced. Furthermore, once the sealant is applied, the bumper blocks must then be moved again and returned to their original positions. Therefore, there are significant drawbacks with removal of bumper blocks from the lot surface.

Alternatively, instead of removing the bumper blocks, some workers apply the blacktop sealant by hand to small areas around each bumper block. The workers typically use brooms, squeegees, or other special equipment to carefully coat a three to four foot perimeter area around each bumper block. This technique significantly slows down the process and thus is less efficient and more costly. In addition to being time-consuming and labor-intensive, this method also results in more pieces of equipment that must be transported between job sites and cleaned after use. If a mechanical spraying device is used to coat the rest of the surface around a bumper block, this burden can become particularly undesirable because the spraying device itself includes numerous components that must be transported and generally maintained.

In another technique, the bumper blocks might be covered with paper or plastic which is taped to surround the block.

However, such preparation is particularly time-consuming. Furthermore, it is messy as the paper or plastic has to then be pulled off of the block when it is covered in sealant. Still further, such a technique has not proven adequate as the seal formed around the bumper block and parking lot surface is usually not adequate to prevent sealant from reaching the block.

Therefore, there is a need in the art for an improved method for applying protective coatings to parking lot surfaces containing bumper blocks. Particularly, it is desirable to complete such a task in a more timely, convenient, and economically efficient manner. And thus, there is a need for an apparatus for achieving such goals.

SUMMARY OF THE INVENTION

The present invention provides a disposable cover for parking lot bumper blocks. The cover comprises a body member that has a cavity and an opening for receiving the bumper blocks. Advantageously, the cover is formed from an elastic polyethylene resin, such as for example ethylene-vinyl acetate (EVA), metallocene or other suitable materials, so that the body member may be expanded in order to accommodate a wide variety of bumper block designs. In an exemplary embodiment, the cover has an elasticity preferably from approximately 20 percent to 75 percent, and more preferably from approximately 20 percent to 30 percent. Consequently, the cover is able to be used with various different bumper blocks that have different height and width dimensions as well as to contract over the bumper block.

The present invention also provides a method of making the disposable cover. To this end, the cover is formed from a tubular sheet of elastic polyethylene resin, which may be produced by blown film extrusion or any other suitable process known in the art. The tubular sheet is aligned in a machine direction and flattened to form opposing sidewalls that are joined together at opposed outer edges along a length of the sheet. To divide the sheet into sections, perforations are formed across a width of the sheet at spaced apart locations along the length of the sheet. The opposing sidewalls are heat sealed together proximate to the spaced apart locations such that the opposing sidewalls define a closed cavity between successive heat seals. The sheet is then cut along its length intermediate the outer edges to provide an opening into the cavities between the opposing sidewalls. Before use, the perforations are torn to form individual disposable covers that may be positioned over the bumper blocks.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION

Figure 1:
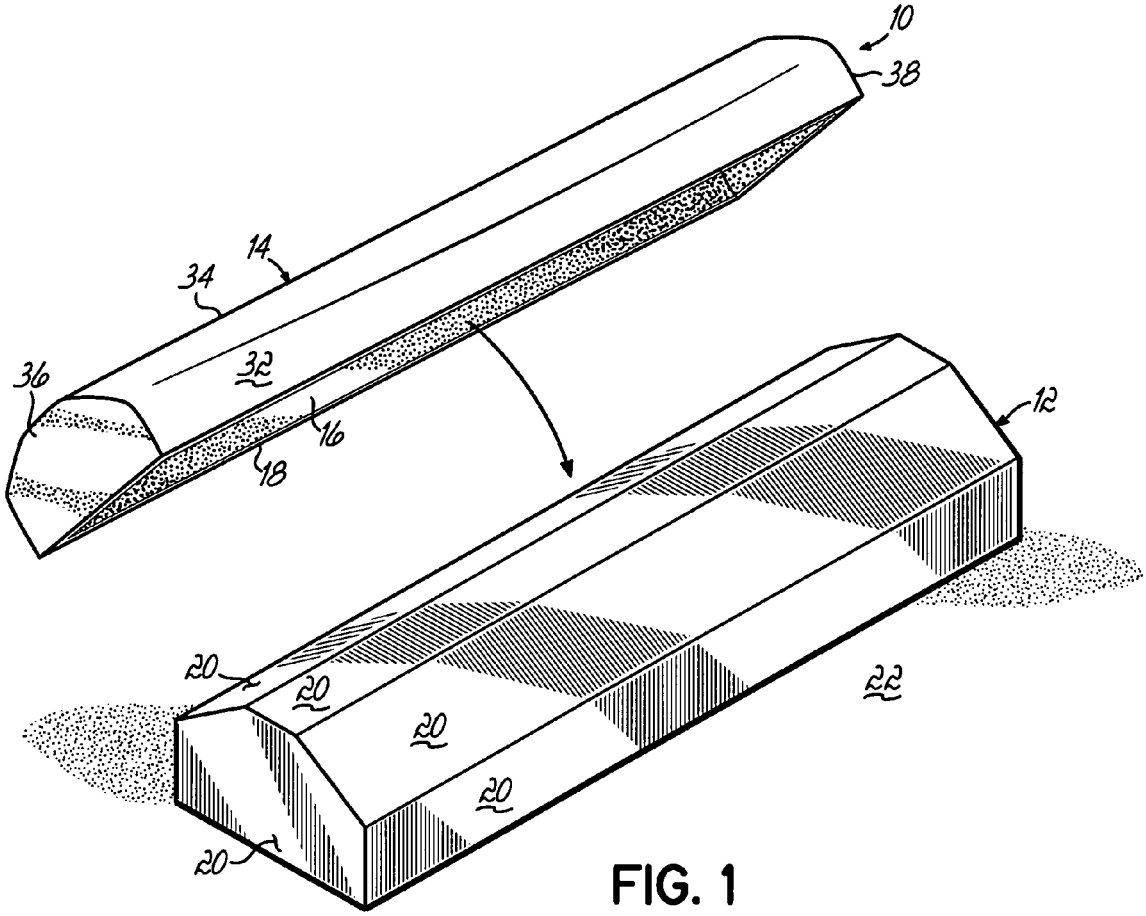
FIG. 1 is a perspective view of a bumper block and a disposable cover according to the present invention.

With reference to FIG. 1, a disposable cover 10 according to the invention is shown. The cover 10 may be used to protect a bumper block 12 from blacktop sealant and the like as it is applied to a parking lot surface, as will be discussed in greater detail below. Although only one type of bumper block design is shown, the present invention may be used to protect a wide variety of other bumper block designs as well. For example, the invention may be used to protect bumper blocks having a rectangular, trapezoidal, or dome-shaped cross-section.

Figure 2:
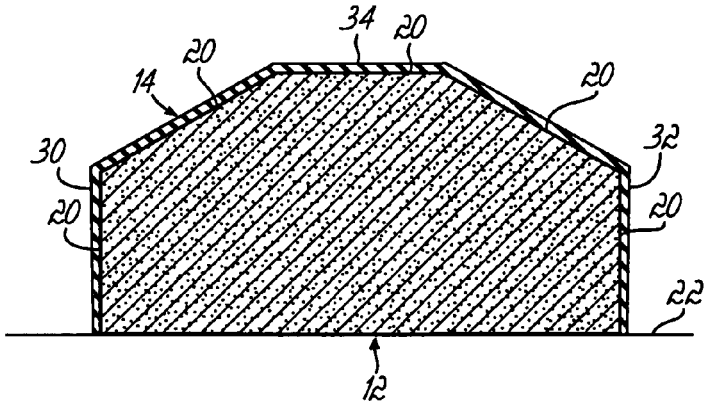
FIG. 2 is a cross-sectional side view showing the cover of FIG. 1 stretched over the bumper block.

With reference to FIGS. 1 and 2, the cover 10 comprises a body member 14 having a cavity 16 and an opening 18 for receiving the bumper block 12. The body member 14 is generally designed to surround, or cover, the exterior surfaces 20 of the bumper block 12 when the bumper block 12 is positioned on a parking lot surface 22. To prevent sealant from splashing or seeping up under the cover 10 onto bumper block 12, the interface between opening 18 and the bumper block 12 must be properly sealed. In accordance with one aspect of the invention, the cavity 16 is typically made smaller than the bumper block 12, and the body member 14 must first be expanded before being placed thereon. FIG. 2 illustrates how the body member 14 may be expanded to conform to the shape of the bumper block 12. In such an embodiment, the body member 14 is defined by opposing sidewall portions 30, 32 that are joined together by a top portion 34 and opposing end wall portions 36, 38. The thickness of the body member 14 is preferably in the range of approximately 0.05 mils to approximately 5 mils, and more preferably is approximately 2 mils.

The expansion qualities of the inventive bumper block are a particularly advantageous aspect of the present invention because there is no standard shape or size for bumper blocks. For example, although a city or state may require bumper blocks to be a certain length, manufacturers are typically free to design their own molds for these objects. As a result, even bumper blocks of the same length often vary in height and width. The term "elasticity" will be used hereinafter to refer to the ability of the inventive cover 10 to expand to accommodate these various shapes and sizes while still maintaining an integral seal around opening 18 to prevent sealant creep onto the bumper block 12. More specifically, the term "elasticity" will be used to refer to the percentage by which the cover 10 may be expanded, or stretched, and be capable of returning to its initial shape to a tight cover seal.

In accordance with a particular aspect of the invention, the body member 14 is formed from a sheet made of an elastic polyethylene resin. For example, the body member 14 may be formed from a ethylene-vinyl acetate resin (EVA) or preferably, the body member 14 may be made from metallocene, such as that sold by Dow Chemical under the product name Metallocene 1880. For the purposes of the present invention, the polyethylene has an elasticity preferably from approximately 20 percent to approximately 75 percent, and more preferably from approximately 20 percent to approximately 30 percent for the bumper block cover.

In another aspect of the invention, the bumper block cover 10 made of the elastic polyethylene resin has the ability, once expanded, to contract or snap back in a shape-recovery fashion to form a tight seal around the opening 18 and at the juncture where the bumper block 12 interfaces with the parking lot surface 22. To that end, the inventive bumper block 12, in some applications forms an under wrap seal at that juncture to fully cover and protect the bumper block 12. No further securing means, such as tape or elastic bands or the like is necessary. When the parking lot surface 22 is coated with blacktop sealant or the like, the cover 10 may be expanded in width and length and placed over the bumper block 12 to protect the exterior surfaces 20 from the spray of a mechanical spraying device (not shown). The expansion of the body member 14 over the bumper block 12 and its vigorous shape recovery once expanded helps provide a tight seal and ensures that no "underspray" reaches the exterior surfaces 20 of the bumper block 12. When the coating operation is complete, the cover 10 may be removed to reveal the uncoated bumper block 12 and then be conveniently disposed of. Thus, rather than taking the time and effort to remove the bumper block 12 or apply the blacktop sealant by hand to an area around the bumper block 12, the cover 10 may be used to improve job neatness and customer satisfaction.

Because covers according to the invention have the ability to expand and vigorously snap back, they can accommodate a wide variety of bumper block designs (e.g., sizes, shapes, etc.). Therefore, the number of different sizes that must be kept on supply is minimized. Furthermore, only the covers are necessary and no additional materials are needed. For example, one cover may be able to accommodate substantially all bumper block designs having a length of approximately four feet regardless of their height or width. Of course, other length blocks might also be handled by appropriately sizing the length of the cover. These covers are lightweight and can be folded or stored on a roll (discussed below) for convenient storage, transportation, and dispensing. Also, the use of a polyethylene resin according to the invention reduces production costs. Because the reduced production costs make it economically feasible to dispose of the covers after use, an operator does not need to worry about maintaining or cleaning the covers.

Figure 3A:
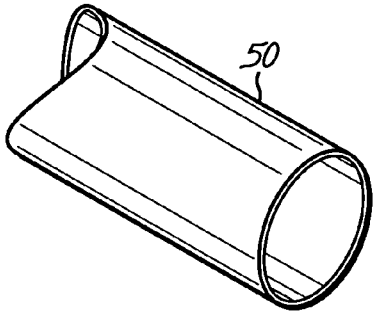
FIG. 3A is a perspective view, partially cut away, of a tubular sheet used to form the bumper block.
Figure 3B:
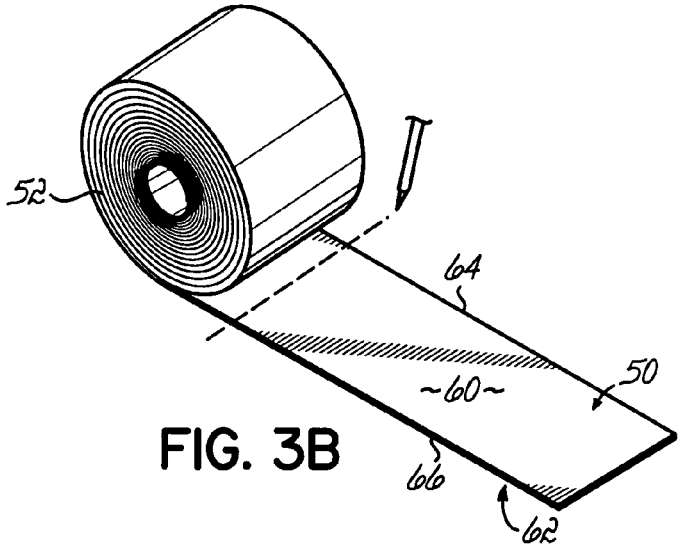
FIG. 3B is a perspective view showing the sheet of FIG. 3A after it has been flattened and collected in a roll.

A method of making the disposable cover 10 in accordance with the invention will now be described. With reference to FIG. 3A, a tubular sheet 50 of an elastic polyethylene resin is formed by a process known in the art. For example, the tubular sheet 50 may be formed by a blown film extrusion process in which the polyethylene resin is melted and forced through an annular die (not shown). The resulting tube in such a process is then inflated with air to form a "bubble." After the bubble has been sufficiently cooled, the tube is typically collapsed, or flattened, by pinch rollers (not shown) and wound onto a drum (not shown). FIG. 3B shows a wound-up roll 52 of a polyethylene resin sheet that has been produced by a blown film extrusion process. The roll 52 may then be unwound so that the sheet 50 is aligned in a machine direction. In a manner not shown herein, the tubular sheet 50 shown in FIG. 3A may be aligned in a machine direction during the final steps of the blown film extrusion process. In other words, the tubular sheet 50 may be flattened and aligned in a machine direction directly by the pinch rollers, thereby eliminating the need to wind the sheet 50 onto a drum.

When the tubular sheet 50 is flattened, it forms opposing sidewalls 60, 62 that are joined together at opposed outer edges 64, 66 along a length of the sheet. To this end, the opposed outer edges 64, 66 represent folds or creases along the length of the sheet 50. One of the challenges associated with flattening the sheet 50 is the presence of "blocking," or the tendency of two adjacent layers of a polymer material to stick to each other because of physical contact. To reduce blocking in the flattened sheet 50, tiny particulates known as antiblock agents may be added to the polyethylene resin. These antiblock agents produce irregularities (i.e., peaks and valleys) on the surfaces of the resin, thereby reducing surface smoothness and the amount of physical contact between the opposing sidewalls 60, 62. A wide variety of particulates may serve as antiblock agents, including synthetic silicas, natural silicas, and natural minerals. For example, calcium carbonate may be added to the polyethylene resin to reduce surface smoothness and prevent blocking.

Figure 3C:
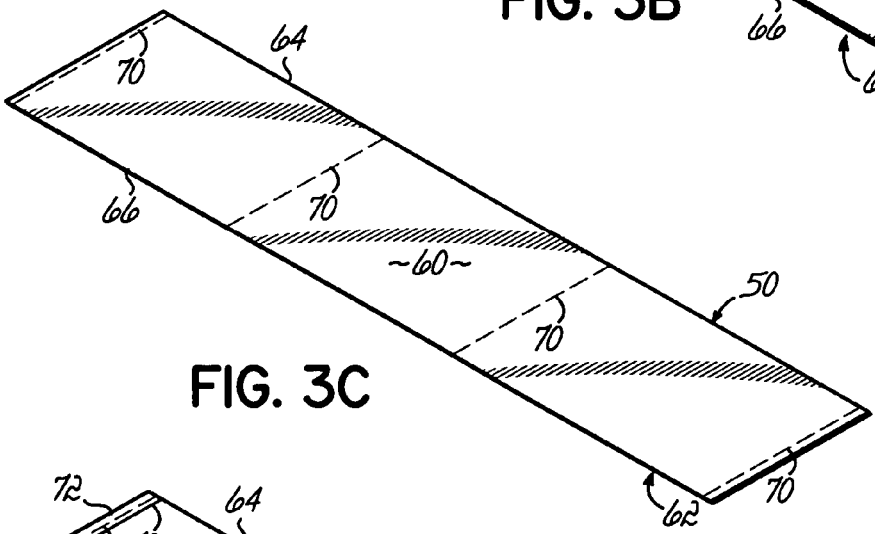
FIG. 3C is a perspective view similar to FIG. 3B showing a section of the sheet with perforations formed at spaced apart locations along a length of the sheet.
Figure 3D:
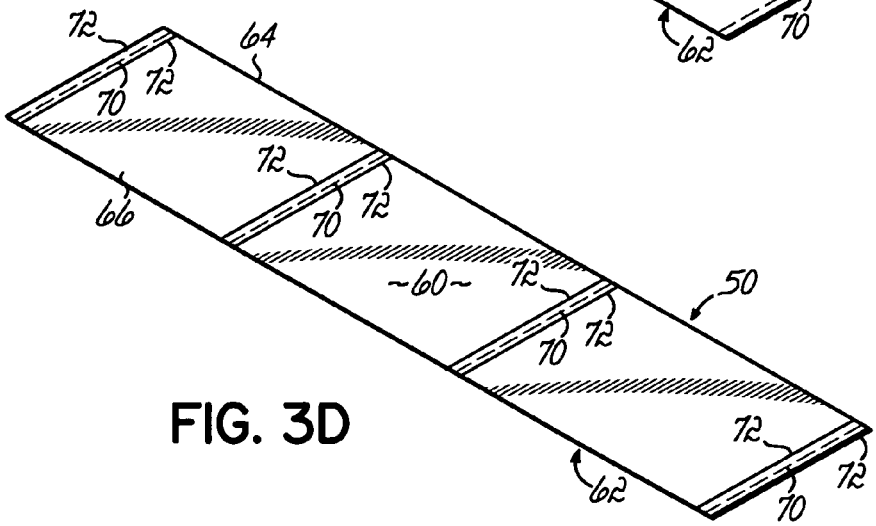
FIG. 3D is a perspective view similar to FIG. 3C showing heat seals positioned proximate to the perforations.

Now referring to FIG. 3C, perforations 70 are formed across a width of the sheet 50 at spaced apart locations along the length of the sheet 50. As shown in FIG. 3D, heat seals 72 are used to join the opposing sidewalls 60, 62 together proximate to the spaced apart locations (where the perforations 70 are positioned). Because the opposing sidewalls 60, 62 are also joined together at the opposed outer edges 64, 66, the opposing sidewalls 60, 62 define closed cavities between successive perforations. In other words, the opposing sidewalls 60, 62 form closed "pouches" or "bags" between the perforations 70. Although the figures illustrate the perforations 70 being formed before the heat seals 72, the steps may be performed in any order.

Figure 3E:
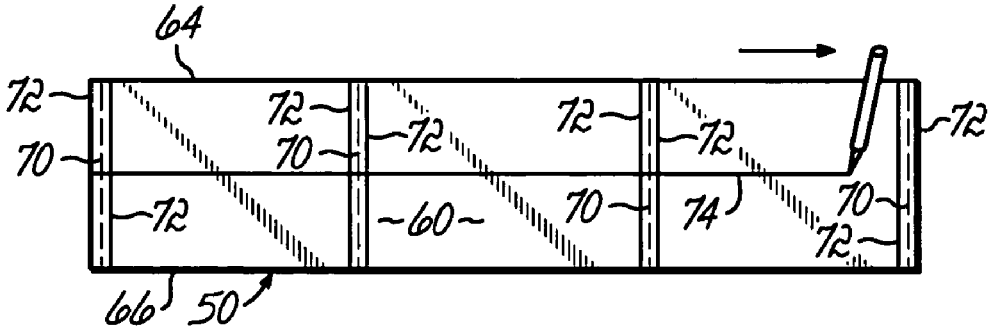
FIG. 3E is a top view showing the sheet of FIG. 3D being cut along its length.
Figure 3F:
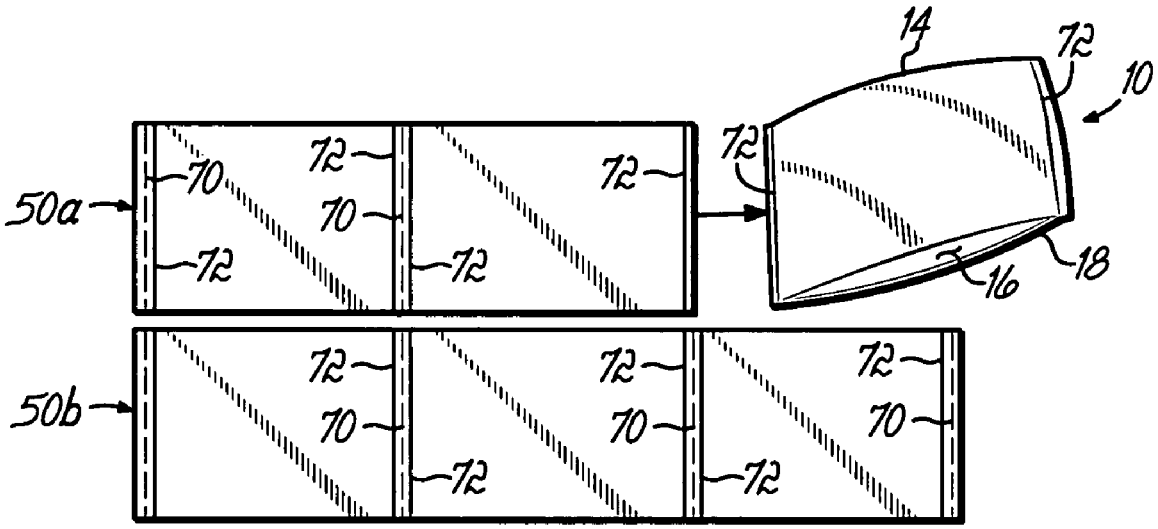
FIG. 3F is a top view similar to FIG. 3E showing a section of the sheet that has been torn along the perforations to form a disposable cover.

With reference to FIGS. 3E and 3F, the sheet 50 is cut along its length to provide an opening into the cavities between the opposing sidewalls 60, 62. Although the sheet 50 may be cut anywhere intermediate the outer edges 64, 66, the embodiment shown in the figures is cut substantially along a centerline 74 so that the sheet 50 is divided into half sections 50*a* and 50*b*. The half sections 50*a*, 50*b* may be used to form individual covers 10 by tearing along the perforations 70. If desired, the half sections 50*a*, 50*b* may be collected on respective take-up rollers (not shown) prior to tearing the perforations 70. The resulting rolls could then be easily transported between job sites with individual covers 10 being torn off when desired.

While the invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicant's general inventive concept.

What is claimed is:

1. A disposable cover for covering a bumper block disposed on a traffic surface to protect it from sealant during a traffic surface treatment process, comprising:

a stretchable body member having a cavity with an opening for receiving the bumper block, the body member being formed from a thin sheet of an elastic polyethylene resin that is readily elastically expandable so that the body member may be expanded to accommodate bumper blocks of varying sizes when the cover is placed thereon and that independently contracts from its expanded condition to form a seal over the bumper block.

2. The disposable cover of claim 1 wherein the polyethylene resin is selected from the group consisting of ethylene-vinyl acetate (EVA) and metallocene.

3. The disposable cover of claim 1 wherein the body member has an elasticity from approximately 20 percent to approximately 75 percent.

4. The disposable cover of claim 3 wherein the body member has an elasticity from approximately 20 percent to approximately 30 percent.

5. The disposable cover of claim 1 wherein the body member has a thickness from approximately 0.05 mils to approximately 5 mils.

6. The disposable cover of claim 1 wherein the polyethylene resin includes an antiblock agent.

7. The disposable cover of claim 6 wherein the antiblock agent is selected from the group consisting of synthetic silicas, natural silicas, and natural minerals.

8. The disposable cover of claim 6 wherein the antiblock agent is calcium carbonate.

* * * * *